United States Patent [19]

Swinney

[11] Patent Number: 4,864,916

[45] Date of Patent: Sep. 12, 1989

[54] RADIAL PUMP/MOTOR

[76] Inventor: Louis E. Swinney, 807 Medford Cir., Olathe, Kans. 66062

[21] Appl. No.: 165,253

[22] Filed: Mar. 7, 1988

Related U.S. Application Data

[63] Continuation-in-part of Ser. No. 907,576, Sep. 15, 1986, Pat. No. 4,768,422.

[51] Int. Cl.[4] ..... F01B 13/06

[52] U.S. Cl. ..... 91/489; 91/494; 91/495

[58] Field of Search ..... 91/488, 489, 491, 494, 91/495, 496

[56] References Cited

U.S. PATENT DOCUMENTS

| | | | |
|---|---|---|---|
| 1,709,194 | 4/1929 | Hele-Shaw et al. | 91/497 |
| 1,757,483 | 5/1930 | Hele-Shaw et al. | 91/497 |
| 1,904,653 | 4/1933 | Davis et al. | 91/497 |
| 2,045,330 | 6/1936 | MacMillan | 91/497 |
| 2,350,683 | 6/1944 | Jossim et al. | 91/496 |
| 2,393,128 | 1/1946 | Temple | 91/496 |
| 2,397,314 | 3/1946 | Grosser | 91/485 |
| 2,651,999 | 9/1953 | Harrington | 91/496 |
| 2,675,764 | 4/1954 | Muller | 91/496 |
| 2,680,412 | 6/1954 | Entwistle | 417/221 |
| 2,932,256 | 4/1960 | Orshansky, Jr. | 91/485 |
| 3,063,380 | 11/1962 | Strickland | 91/489 |
| 3,096,723 | 7/1963 | Puryear | 91/485 |
| 3,124,079 | 3/1964 | Boyer | 91/505 |
| 3,125,034 | 3/1964 | Lucien et al. | 417/273 |
| 3,777,624 | 12/1973 | Dixon | 91/488 |
| 4,011,796 | 3/1977 | Erickson | 91/495 |

FOREIGN PATENT DOCUMENTS

| | | | |
|---|---|---|---|
| 363466 | 6/1938 | Italy | 91/497 |
| 48608 | 8/1986 | Japan | 417/273 |

*Primary Examiner*—William L. Freeh

*Attorney, Agent, or Firm*—Kokjer, Kircher, Bradley, Wharton, Bowman & Johnson

[57] ABSTRACT

A hydraulic pump/motor in which working piston elements are arranged for radial reciprocation. A cam is arranged eccentrically to a rotor which carries the pistons. Fluid cavities are provided in feet on the pistons, in the faces of a polygon to which the feet are attacahed, and in bearing pads in the outer ends of the cylinders to provide hydrostatic balancing. The pistons are hollow and are equipped with check valves to prevent centrifugal force from expelling fluid from the polygon and foot cavities. The cam includes mating spherical surfaces which compensate for bending forces applied to the cam. An improved mechanism for adjusting the cam position uses inherent forces to eliminate the need for a power assist device for cam adjustment. Port plates on opposite sides of the rotor provide inlet to the unit near the axis of the unit and outlet near the outer edge to alleviate stresses and increase efficiency.

16 Claims, 2 Drawing Sheets

RADIAL PUMP/MOTOR

RELATED APPLICATION

This application is a continuation in part of my pending application, Ser. No. 907,576, filed on Sept. 15, 1986, now patent No. 4,768,422, and entitled "Pump Motor".

FIELD OF THE INVENTION

This invention relates in general to fluid power transmission and, more particularly, is related to radial piston units in which the working piston elements are disposed radially in cylinders bored in a rotor, concentrically journaled in a circular housing and the pistons being caused to reciprocate relatively in their respective cylinders while moving in a defined circle around an eccentrically positioned cam.

BACKGROUND OF THE INVENTION

Piston operated hydraulic pumps and motors have long been used in a wide variety of applications involving fluid power transmission. When operated as a pump, an input shaft is driven rotatively and fluid is then pumped from an inlet side of the unit to a discharge side. When operated as a motor, fluid under pressure is directed into the unit which then drives an output shaft. A plurality of pistons are reciprocated in cylinders, either by the turning of a shaft in the pumping mode of operation or by the fluid pressure when operating as a motor.

Piston pumps and motors are generally classified either as axial units in which pistons are disposed to operate parallel with the axis of rotation of a piston carrying rotor or as radial units in which the pistons are disposed perpendicular to the said axis.

It is the object of this invention to provide a radial unit of a superior design. It is a further object to provide advantages not found in the alternative axial units.

To clarify the advantages of my invention, it is necessary to compare similar functions of the two basic designs. When in operation, the geometric differences in the two types of units create profoundly different dynamic and hydrostatic force patterns and therefore present vastly different engineering and design considerations.

One of the problems of both of these types of units is that of introducing fluid into the cylinders of a spinning rotor. The centrifugal force generated by the rotor creates a tendency to expel fluid from the cylinders. The presently marketed units require a pressurized fluid supply to the inlet port.

Certain design problems inherent in the radial configuration are explained in my co-pending application, No. 907,576 filed Sept. 15, 1986 and entitled "Pump/Motor". The said application describes the use of hydrostatically balanced or "floating" port plates fitted to a rotor and having passages extending radially to the outer ends of the cylinders.

These two features, each having little value without the other, combine to solve two important problems inherent in the radial design. The first, that of providing a sliding seal between the stationary port plate and the revolving rotor, which seal remains in sealing contact even when subjected to extreme temperature variations, and the second, that of introducing fluid into a spinning rotor in a manner to utilize the centrifugal force of the rotor to create a suction at the inlet opening, thereby making a pressurized fluid supply to the pump unnecessary.

An analysis of this combination, as well as other design features of the unit described in my co-pending application, has revealed certain function and design problems which are remedied in the present invention.

I have found that the advantage gained by introducing fluid at an inward location is at least partially lost when the fluid is forced back through the radial passages against centrifugal force to the outlet port.

This analysis has also revealed another design problem created by the aforementioned combination. Considerable force is exerted against the rotor by the telescopic piston devices used to hold the port plate against the rotor when subjected to the high pressures normally generated by this type of unit. The magnitude of this thrust force requires that very substantial bearings be used in journaling the rotor in the housing.

I have found that by placing a second port plate on the rotor opposite the first port plate, the equal and opposite forces of the two will alleviate the thrust stresses created by the single port plate. Further, if this second port plate is located near the outer periphery of the rotor, fluid can be expelled at the outer parts of the unit and need not be forced back to the inboard ports.

This single addition solves these two problems found in my co-pending application. Further analysis of the unit as described in my pending application has produced a finding that, if not constrained, the forces of the pistons against the cam while the unit is working, will be of sufficient magnitude to displace the cam from a pre-selected position. The force pattern of the pistons against the cam alternates from one direction to the opposite direction as the pistons move around the cam.

The present invention provides a means for connecting the cam to the housing by linkage to prevent undesired movement of the cam position and further provides a means of adjusting the said linkage to effectively adjust the stroke of the pistons and therefore the volume of fluid displaced by the unit.

The alternating forces of the pistons acting against the cam provide the force needed to position the cam. The said linkage is needed therefore to simply constrain against undesired movements of the cam and to provide a means of selecting the desired piston stroke.

This phenomenon, that of alternating forces of pistons against the cam, found in the radial unit, is of great significance when contrasted to the alternative axial units which require a power assist feature, in the larger units, to aid the operator in controlling the stroke of the pistons; ergo, the displacement of the unit. The tendency of rotating objects is to move in a circular path. In the axial units, this tendency of the pistons to move in a circular path creates a resistance which must be overcome in order to achieve piston stroke. In the larger units operating at high speeds, this natural tendency to follow a true circular path is quite substantial.

The need for auxiliary power to effect the changes in the volumetric displacement and the need for a pressurized fluid supply to the inlet port required in the alternative axial units are two important considerations when contrasted with the present invention which requires no auxiliary power.

Further analysis of the unit as described in my pending application has revealed several design deficiencies in respect to to excessive stresses on various component which will result in excessive friction and wear.

It is an object of this invention to provide a radial piston fluid pump/motor in which all of the undesirable characteristics found in the unit described in my pending application are satisfactorily resolved.

It is a further object of this invention to provide a means of controlling the position of the cam block, as described in my co-pending application, thereby effecting a precise control of the volume of fluid displaced by the unit.

It is a further object of this invention to provide a radial piston fluid pump/motor having a minimum of stress forces acting on all moving parts.

It is a further purpose of this invention to provide a more compact variable displacement fluid pump motor than is available in today's market.

It is a further purpose of this invention to provide a fluid pump/motor that is easily assembled and repaired and, further, convertible from a fixed volume unit to a variable volume unit with minimal effort.

SUMMARY OF THE INVENTION

The pump/motor described herein is designed to make advantageous use of the dynamic and hydrostatic forces that are at work when the machine is in operation. As a consequence, enhanced efficiency is achieved and the inherent benefits of the radial design as to size, weight, cost and complexity are fully achieved.

In accordance with the invention, a radial pump/motor unit includes a rotor which is journaled to rotate concentrically about a cam positioned eccentrically in the housing. The rotor carries a plurality of pistons which reciprocate relatively in radially arranged cylinders and which have flat surfaced shoes bearing against the flat surfaces of a polygon which rotates on the cam. Both the flat surfaces of the piston shoes and the inner surface of the polygon are provided with cavities which receive fluid under pressure. The surface area of these cavities are slightly less than the cross sectional area of the cylinders so that the force resulting from fluid pressure is sufficient to maintain the components in sealing contact. This hydrostatic cushion reduces the area of metallic contact of the components which alleviating the friction producing stresses acting on the sliding components.

It is a special feature of the invention that the pistons are hollow, both to reduce the weight and to provide fluid passages into the cavities of the piston shoes and the polygon. A check valve in each piston allows fluid to flow to the cavities and closes under the influence of centrifugal force to prevent the fluid from being centrifugally expelled from the said cavities when the rotor is spinning.

It is another special feature of the machine that the cylinder bores extend from the center of the rotor through the outer periphery and are equipped with bearing pad inserts fitted to the end of each cylinder bore which bear against a stationary sleeve in the housing of the unit. Each bearing pad has a cavity in its outer surface adjacent to the sleeve and a fluid passage for delivery of fluid to the cavity from the cylinder. This arrangement provies for hydrostatic balancing to alleviate stress on the rotor bearings generated by the force of the pistons against the cam.

An inlet porting arrangement delivers fluid near the axis of the machine and has a configuration that takes advantage of centrifugal force to assist in delivery of the incoming fluid to the outer ends of the cylinders. Outlet ports are located adjacent the outside of the housing so that the fluid from each cylinder is discharged outwardly to take advantage of centrifugal force generated by the spinning rotor and port plates on both sides of the rotor alleviate thrust force stresses on the rotor carrier bearings.

The cam has a novel construction which compensates for possible bending which might result from stress forces applied by the pistons bearing against it. A spherical sleeve is fitted over the central cam and mates with a spherical inside surface of a cylindrical sleeve fitted to the spherical sleeve. A polygonal sleeve in turn fits on the outer sleeve of the cam assembly.

By virtue of this construction of the cam, proper alignment of the surfaces of the polygon and the piston shoes will be assured even if bending occurs to the central cam pin. This arrangement assures proper seating of the piston shoe against the polygon, insuring an unbroken seal between these two surfaces.

As still another important feature of the invention: a unique cam adjustment mechanism is provided for accurately adjusting the displacement of the unit without the need for power assistance. The cam adjustment system is designed in such manner as to utilize the alternating forces of the pistons acting upon the cam to move the cam to a desired position, while providing adjustable linkage between the cam and the housing in a manner to lock the cam in its desired position.

DETAILED DESCRIPTION OF THE INVENTION

In the accompanying drawings which form a part of the specification and are to be read in conjunction therewith and in which like reference numerals are used to indicate like parts in the various views.

Figure 1:
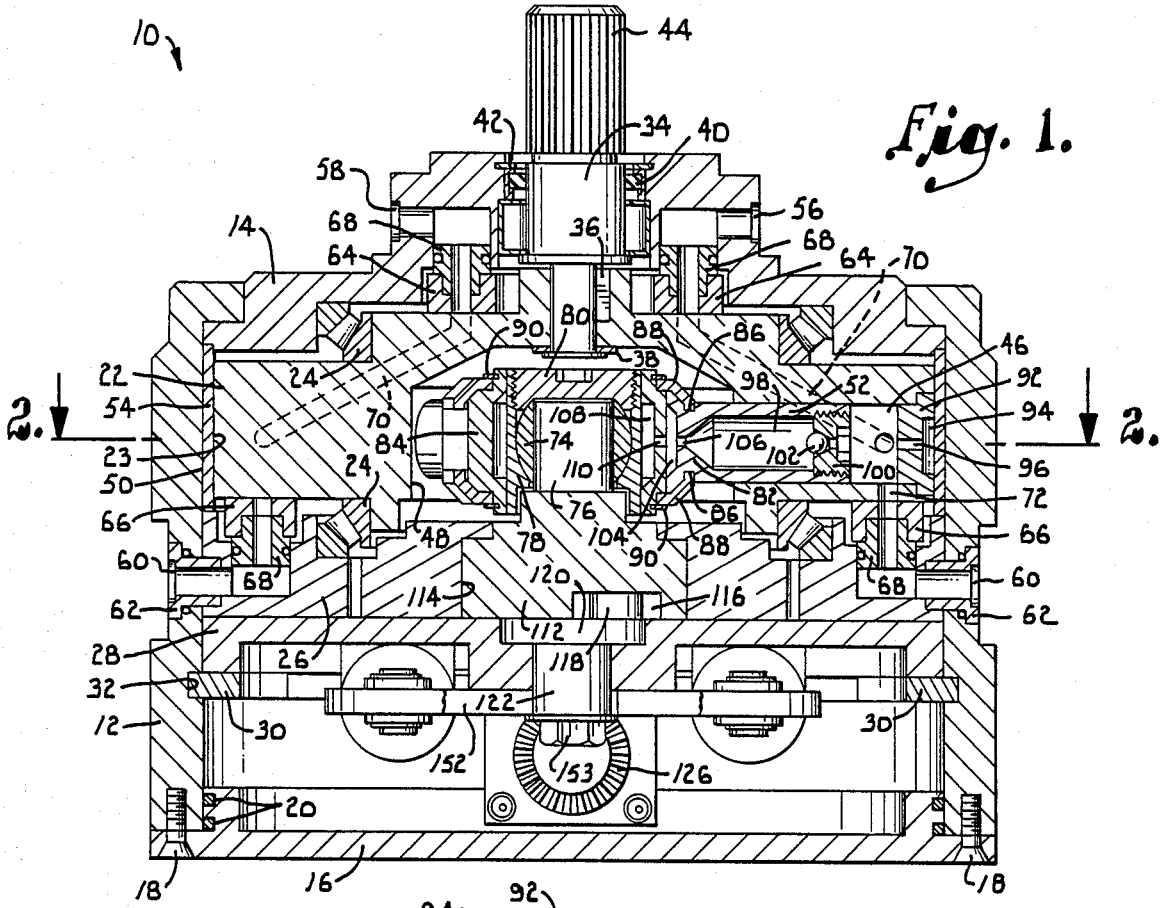
FIG. 1 is a sectional view taken longitudinally through a radial pump/motor unit constructed according to a preferred embodiment of the present invention.

Referring now to the drawings in more detail, numeral 10 generally designates a radial pump/motor unit constructed in accordance with the present invention. The pump/motor unit 10 in many respects is constructed similarly to the unit disclosed in my co-pending application, Ser. No. 907,576, filed on Sept. 15, 1986 and entitled "Pump Motor". The present invention is a continuation in part of the above reference application, and the entirety of said application Ser. No. 907,576 is hereby incorporated by reference.

The pump/motor unit 10 operates hydraulically and may be used as a pump to pump liquids or as a motor driven by fluid pressure. A generally cylindrical housing 12 contains the operating components of the unit. A cover 14 encloses the operating components at the top end of housing 12, while a cover plate 16 is secured to the opposite lower end of the housing by screws 18. Seal rings 20 provide fluid tight seals between the cover plate 16 and the housing 12. Similar seal elements (not shown) are used to effect a seal between cover 14 and housing 12.

A generally annular rotor 22 is supported for rotation within a rotor chamber 23 in housing 12 by a pair of tapered roller bearings 24. One of the bearings 24 is located between cover 14 and rotor 22, while the other bearing 24 is located between the rotor and an underlying plate 25 which is mounted within the housing. Plate 26 is mounted on a backing plate 28 which is secured in place by a plurality of arcuate plates 30. The plates 30 fit at their edges in an annular groove 32 formed in the inside surface of housing 12. The retainer plates 30 may be bolted at 33 (FIG. 3) or otherwise secured to the backing plate 28.

A shaft 34 extends through cover 14 and is connected with rotor 22 and a flange on the end of shaft 34. A seal ring 40 held by a retainer ring 43 provides a fluid tight seal between the shaft 34 and cover 14. The external end of shaft 34 is splined at 44 to facilitate connection with another shaft.

Figure 2:
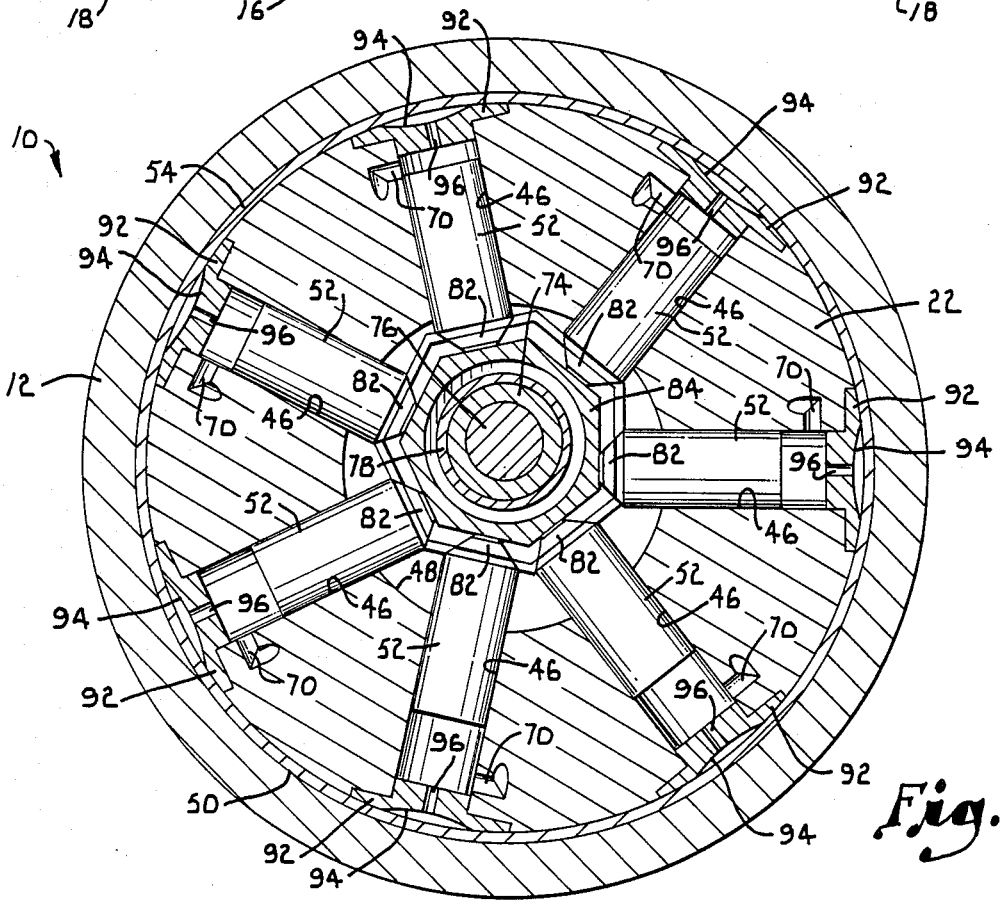
FIG. 2 is a sectional view taken generally along line 2—2 of FIG. 1 in the direction of the arrows.

As best shown in FIG. 2, a plurality of cylinders 46 are bored radially through the rotor 22 between the inside surface 48 of the rotor and the outside surface 50 of the rotor. The cylinders 46 are spaced apart equally from one another with their axes intersecting at the rotor axis about which rotor 22 turns. Each cylinder 46 receives a piston 52 which reciprocates in the cylinder as the rotor 22 spins. A metal sleeve 54 is fitted against the inside surface of housing 12. The inside diameter of sleeve 54 is slightly larger than the exterior diameter of the rotor 22 which allows the rotor to turn freely inside the sleeve 54. Sleeve 54 provides a bearing surface against which bearing pad cylinder inserts 95 bear during operation of the unit.

With particular reference to FIG. 1, cover 14 is provided on one side with a pair of inlet ports 56 which receive hydraulic fluid into the pump/motor unit. A pair of additional inlet ports 58 are provided on the opposite side of cover 14. Outlet ports 60 are formed in fittings 62 which are suitably secure through openings in opposite sides of the housing 12 located below the rotor. Fluid is distributed from the inlets 56 and 58 to the cylinders 46 by manifolds 64 which fit against rotor 22 in the area of the inlets. Additional manifolds 66 distribute fluid from the cylinders to the outlet 60.

Each manifold 64 and 66 has a similar construction. Each manifold has an arcuate configuration and is provided with a plurality of spaced apart openings which receive pins 68 having enlarged head portions projecting out of the manifold openings. The pins 68 have passages which communicate with the inlets and outlets and with grooves in the manifolds 64 and 66. By this arrangement, fluid from the inlets 56 or 58 is directed through manifold 64 and through inclined passages 70 which extend outwardly through rotor 22 and connect with the outer ends of the cylinders 46. Each cylinder 46 has one passage 70, and the location and arrangement of manifold 64 is such that the proper passages 70 are disposed in communication with the inlets 56 or 58, depending upon the rotative position of the rotor.

The manifolds 66 for outlets 60 function similarly to discharge fluid from the cylinders 46. The manifolds 66 communicate with appropriate discharge ports 72 located in the outer ends of the cylinders. By properly locating the manifolds, the fluid intake and discharge is regulated in order to permit the pistons 52 to properly reciprocate in their cylinders 46.

For example, during operation each manifold 64 and 66 is in communication with approximately one half of the rotor. When the rotor is turning clockwise as viewed in FIG. 2, the inlets must supply fluid to the cylinders on the right half of the rotor because their pistons are moving inwardly. Conversely, the outlets must receive fluid from the pistons on the left half of the rotor. Thus, the inlets 58 should then be closed and the outlets 60 on the right side should also be closed. If the rotor is turning in the opposite direction (counter clockwise), the cylinders on its left half require fluid and those on its right half must discharge fluid. In this situation, the inlets 56 should be closed along with the outlets 60 on the left side. The provision of plural manifolds both above and below the rotor results in symmetry and a balance of the hydrostatic forces to which the rotor is subjected, thus reducing the loading of the rotor bearings 24.

Reciprocation of the pistons is effected by a cam assembly which is eccentric to the rotor and which includes a spherical sleeve 74 fitted on a pin 76. The spherical sleeve 74 has a spherical outside surface that fits against a mating spherical surface formed on the inside of another sleeve 78 having a cylindrical outside surface. Sleeves 74 and 78 are held together by a plug 80 which is threaded into the upper portion of sleeve 78.

The inside end of each piston 52 has a foot 82 which is coupled with a polygon 84. The polygon 84 fits closely around sleeve 78 and rotates thereon with the rotor 22. As best shown in FIG. 2, the polygon 84 has seven flat sides which are coupled with the feet 82 of the respective pistons 52. Each foot 82 has upper and lower grooves 86 which receive upper and lower lock down plates 88. The lock down plates 88 are in turn secured to the faces of polygon 84 by snap rings 90. This arrangement allows the feet 82 of the pistons to slide laterally parallel with grooves 86 as the pistons reciprocate in their cylinders. At the same time, the connections between the feet of the pistons and the flat faces of the polygon cause the pistons to reciprocate in their cylinders as rotor 22 rotates concentrically about the eccentrically located cam assembly. Each foot 82 preferably has a rectangular base surface which confronts the polygon to maximize the use of area.

The outer end of each cylinder is equipped with a cylinder insert bearing pad which bears against sleeve 54. Each cylinder insert is provided with a cavity 94 on its outer side adjacent to the bearing surface provided by the sleeve 54. A passageway is formed through each cylinder insert 92 in order to convey fluid from the cylinder 46 to the cavity 94.

It is noted here that the entire housing cavity is filled with fluid before the unit is operated, as is the case with all similar fluid pumps or motors. The presence of air or air pockets can cause damage to internal parts.

It is also noted that each cylinder and its accompanying passages and cavities are alternately subject to very high pressures and little or no pressures at other times. It is therefore noted that certain functions of components change with alternating pressures and force patterns.

As shown in FIG. 1, each piston is hollow to provide a passage 98, through the piston. A check valve for each system includes a valve seat 100 which is threaded into the outer end of the piston. A ball element 102 is located in passage 98 and may be seated on the valve seat 100 in order to close the passage 98 to fluid flow. A cavity 104 is provided on the inside surface of each piston foot 82 and connects with the passage 98 through a port 106. Similarly, each flat face of the polygon 84 presents a cavity 108 adjacent the sleeve 78. Cavities 104 and 108 are connected by a port 110 formed through the flat faces of the polygon. The pin 76 on which the spherical sleeve 74 is fitted projects from a block 112 which is received in an opening 114 in plate 26. The block 112 may be moved linearly in opening 114 to position the cam assembly concentrically or at any desired eccentric position relative to the axis of rotor 22, thereby adjusting the length of the stroke of each piston to vary the volume of fluid displaced by the unit. A plate 116 is received in a rectangular opening formed on the underside of block 112. Plate 116, in turn, receives a pin 118 which projects from a disc 120. Disc 120 is carried on a shaft 122. Disc 120 and shaft 122 are fitted into annular openings in plate 28. Pin 118 is axially offset from shaft 122 so that pin 118 and plate 116 provide for linear adjustment of block 112 in opening 114 upon rotation of shaft 122.

Figure 3:
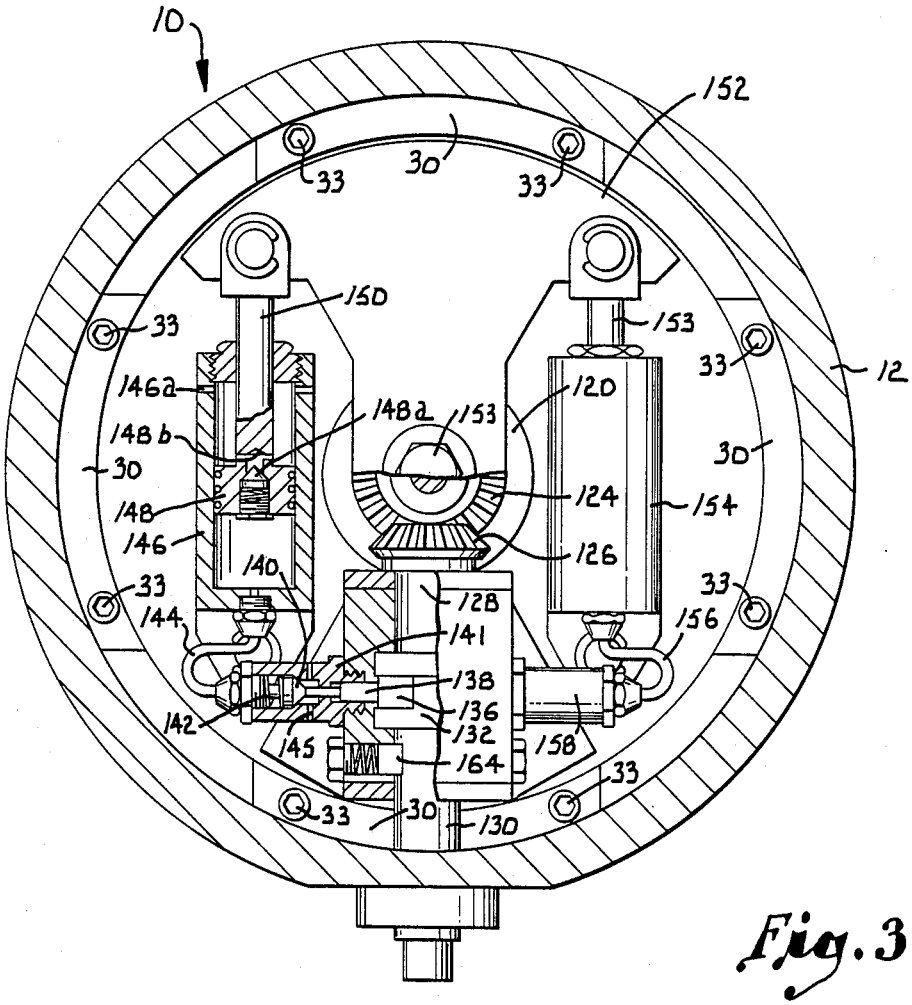
FIG. 3 is a diagrammatic bottom end view of the pump/motor unit with the cover plate removed and portions broken away to illustrate the construction of the cam adjustment mechanism.

The mechanism by which block 118 and the cam assembly are positioned is best illustrated in FIG. 3. A bevel gear 124 is mounted on the lower end of shaft 122 and mates with another bevel gear 126. Gear 126 is carried on a shaft 128 which is axially aligned end to end with another shaft 110 having one end accessible from the outside of the housing 12. The adjacent ends of shafts 128 and 130 have protruding bosses which are diametrically opposed and between which is placed a crescent shaped key 136. Shaft 128 is normally held in place by linkage to the housing. When shaft 130 is turned relative to shaft 128, the crescent key is forced radially outwardly away from the axes of the shafts.

The outside surface of key 136 bears against a plunger 138 which carries a valve head 140 on its opposite end. The valve head 140 forms a part of a valve 141 and is normally held in a seated or closed condition by a compression spring 142. When the valve head 140 is unseated, fluid is communicated through valve 141 between a serpentine passage 144 and ports 145 which open into the internal cavity of the housing.

Passage 144 extends to one end of a fluid cylinder 146 which contains a piston 148. Extending from piston 148 is a piston rod 150 which connects with one side of the cross head of a control arm 152. The control arm is connected at 153 with shaft 122 connected with the opposite side of the cross head of the control arm 152 is the rod 153 of another fluid cylinder 154 which is identical to cylinder 146. A similar serpentine passage 156 extends from cylinder 154 to valve 158 which is identical to valve 141 on the opposite side of the unit. The piston in each cylinder 146 and 154 is equipped with a check valve **148*a* for piston 148 which allows fluid to flow through rod ports 148*b* and through the piston port from the rod end only, to the base end of the cylinders. Each cylinder has ports at its rod end (146*a* for cylinder 146**), to provide replenishing of fluid in the cylinder when the piston moves in a direction which enlarges the rod end volume.

A centering detent for the cam adjustment mechanism is provided by a pin 160 which is urged by a compression spring 162 into a notch 164 in shaft 128. Pin 160 and notch 154 register only in the "neutral" position or concentric position of the cam mechanism when both rods 150 and 153 are equally extended. Compression springs 162 urge pin 160 against the flat surface of shaft 128 having the effect of causing the unit to cease functioning upon release of turning or holding force of control shaft 130.

To operate the unit 10 as a pump, shaft 34 is driven rotatably to drive rotor 22 about the cam assembly. As the rotor 22 turns, fluid is drawn in the inlets 56 or 58 and through passages 70 into the outer ends of the cylinders 46. The intake path of the fluid is generally from inside to outside so that the centrifugal force of the spinning rotor propels the fluid to the cylinders creating a suction at the inlet openings.

While the unit is inactive the ball element 102 is in an unseated position. During the filling of the pump/motor cavity, only gravity is used to carry the fluid to all internal areas of the unit. The fluid is thus able to flow into hollowed piston 98, and through ports 106 and 110 to the fluid chambers 104 and 108. When pressure is present in the cylinders during the operation of the unit the pressurized fluid in these chambers create a fluid "cushion" effect which allows the piston feet 82 to glide on the flat faces of the polygon 84 and allows the polygon to easily turn on sleeve 78.

Also, during operation of the unit, the centrifugal force of the spinning rotor causes the ball elements 102 to be seated against seats 100 and the fluid in passage 98 and chambers 104 and 108 is prevented from being centrifugally expelled during the inlet function.

It is noted that the fluid in each cylinder 46 is free to flow through passage 96 to cavity 94 located adjcent to sleeve 54. When pressure is present, a fluid "cushion" is provided which allows the bearing pads 92 to glide along sleeve 54, thus reducing the radial stresses created by the forces of the piston against the cam which would otherwise be borne by the rotor bearings 24. This alleviation of stresses reduces wear and extends the life of the rotor bearings.

During the intake of fluid to the cylinders when there is no pressure on the cylinder chambers, the centrifugal force of the spinning rotor holds the cylinder inserts 92 in sealing contact with the sleeve 54. This sealing effect prevents loss of fluid from the cavities 94 which would otherwise require replenishment with each revolution of the rotor.

The fluid which is drawn into the cylinders 46 is subsequently expelled therefrom as the pistons 52 are reciprocated outwardly toward the outer ends of the cylinders. The fluid is discharged through ports 72 and 60 on the pressure side of the pump.

It is noted that when pressure is in evidence in any cylinder, all cavities and passages in communication with the said cylinder are subject to equal pressure. The fluid pressure, therefore, is communicated through the rotor passages 70 to the inlet port plate. The pressure present in the bores into which the port plate pins 68 are fitted create a force against the top of rotor 22 by the port plate 64. This thrust force of the port plate against the rotor is of significant magnitude being equal to the cross sectional area of the cylinders containing pins 68 multiplied by the pressure of the system. If, for instance, the total area of the said cylinders is two square inches and the system pressure is five thousand pounds per square inch, then the total force of the port plate 64 against the rotor 22 is 10,000 pounds of thrust force. The force of the port plate 66 on the opposite of the rotor is, by virtue of design, forced against the rotor 22 with a force equal to the said opposite top port plate.

This feature causes an equalization of the thrust forces caused by the opposing port plates 64 and 66 against the rotor 22, thereby alleviating thrust stresses on the rotor bearings 24.

It is again noted that the fluid flow direction is generally from inside to outside so that centrifugal force is utilized effectively to increase the overall efficiency of the unit.

The unit 10 operates in an inverse fashion as a motor. Then, hydraulic fluid under pressure is forced in through the inlets 56 or 58, depending upon which direction shaft 34 is to be driven. The incoming fluid forces the pistons 52 inwardly, thereby causing rotor 22 to rotate due to the eccentric arrangement of the cam assembly. The pistons on the opposite side of the rotor move outwardly when the rotor is rotated and the fluid in these cylinders is expelled through the outlet ports. Rotor 22 is thus driven rotatively, and this in turn drives shaft 34 and whatever equipment is connected with it.

During operation of the unit in either the pumping mode or the motor mode, hydrostatic balancing is provided by the fluid which is directed into chambers 94, 104 and 108. As previously indicated, the area presented in each chamber is somewhat smaller than the cross-sectional area of cylinder 46, so as to assure a sealing effect between the relative components. The overall result is efficient operation and reduced frictional effects.

Adjustment of the capacity of the unit may be carried out by turning the control shaft 130 either manually through a lever or automatically through a suitable automatic adjustment system. When the cam adjustment system is in the neutral position, the rods of both cylinders 146 and 150 are extended equally and pin 76 is located on the rotor axis. Then, there are no hydraulic forces which tend to move the cam in either direction. Consequently, the control shaft 130 can be turned with little effort in order to initiate pumping action. It is noted that with the adjustment mechanism in the neutral position, the valves 140 and 158 are both closed so that fluid cannot escape from either cylinder 146 and 154.

If shaft 130 is turned in a direction to force the crescent shaped key 136 outwardly, the force applied against plunger 138 unseats valve head 140 and thus allows fluid to bleed from the base end of cylinder 146 through passage 144 and ports 145. Concurrently with the unseating of valve head 140, shaft 128 turns the bevel gears 126 and 124 in a direction to rotate the control arm 152 counterclockwise as viewed in FIG. 3. Since fluid is allowed to bleed from cylinder 146, retraction of rod 150 is permitted as the control arm 152 rotates. Thus, the cam assembly is moved away from the rotor axis to an eccentric position at which pumping action takes place. It is noted that only a small amount of fluid can bleed through the relatively small passage 144, so only enough fluid is allowed to flow to provide a smooth transition in the changes in position of the various components.

When the desired position of the cam assembly has been reached, the force of the two bosses 132 and 134 against key 13 is relieved, and all circuits are then closed once again and the system is locked in position until control shaft 130 is activated again in either direction. As piston 148 moves downwardly in cylinder 146, fluid from within the internal cavity of the pump/motor unit is allowed to flow into cylinder 146 above the piston through ports **146*a*. Concurrently with the retraction of rod 150, the rod 153 of cylinder 154 extends, and cylinder 154** experiences a reverse flow of fluid (i.e., fluid flows from within the cylinder through the rod ports and past the check valve in the piston into the base end of the cylinder). When the cam control adjustment cycle has been completed, the check valves are again in their seated positions to block fluid flow and prevent further movement of the cam.

In this manner, the cam adjustment mechanism takes advantage of the hydrostatic forces of the pistons against the cam to achieve a quick and easy adjustment of the cam position which varies the piston stroke and the volume of fluid that is pumped. Because fluid pressure assists rather than resists movement of the cam, the cam adjustment can be carried out with little effort and no need for fluid pumps or other power assist equipment. At the same time, the cam is securely held in place against the forces applied to it during operation of the machine. The absence of any need for power assistance equipment allows the pump/motor unit 10 to be constructed in a simpler and more compact manner than is possible with units that require power assistance for the cam adjustment.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limited sense.

Having thus described the invention, I claim:

1. Radial pump/motor apparatus, comprising: a housing defining a rotor chamber therein and having a fluid inlet for receiving fluid and a fluid outlet for discharging fluid;

an annular rotor mounted in said rotor chamber for rotation about a rotor axis, said rotor having inner and outer surfaces;

a plurality of spaced apart cylinders extending radially of the rotor axis through the rotor between said inner and outer surfaces thereof, each cylinder having inner and outer ends respectively adjacent the inner and outer surfaces of the rotor;

a piston received in each cylinder for reciprocation therein radially of the rotor axis;

cam means eccentric to the rotor axis for reciprocating the pistons, said cam means including a cylindrical member and a polygon mounted to rotate on said cylindrical member and having a plurality of flat sides equal in number to the number of pistons;

a foot on each piston, said feet being coupled with the respective flat surfaces of said polygon to effect reciprocation of the pistons in the cylinders when the rotor turns about said rotor axis;

a passage through each piston for conveying fluid between the inner and outer ends of the cylinder;

a cavity between each flat side of the polygon and said cylindrical member;

a port in each flat side of said polygon for conveying fluid from the inner end of each cylinder to the corresponding cavity;

check valve means in each passage for accommodating fluid flow therein in a direction from the outer end of the cylinder toward the inner end but preventing fluid flow in the opposite direction; and means for selectively providing communication between said outer ends of the cylinders and said inlet and outlet in a manner to allow the pistons to reciprocate in the cylinders during rotation of the rotor.

2. Apparatus as set forth in claim 1, wherein said means for selectively providing communication comprises:

inlet means for introducing incoming fluid to the cylinders at a location on said housing in proximity to said shaft; and outlet means for discharging fluid from the cylinders at a location radially outward from said inlet means, said inlet means and outlet means being on opposite sides of the rotor.

3. Apparatus as set forth in claim 1, wherein said check valve means comprises:

a valve seat in each passage; and a valve element in each passage having a seated position blocking flow through the valve seat and an unseated position allowing flow through the valve seat, said valve element being seated when the pressure in the passage exceeds the pressure in the cylinder and being unseated when the pressure in the cylinder exceeds the pressure in the passage.

4. Apparatus as set forth in claim 1, including:

a bearing surface of the housing adjacent the outer surface of the rotor; and a bearing pad in the outer end of each cylinder bearing against said bearing surface, each bearing pad having a fluid chamber therein adjacent said bearing surface and a passageway for directing fluid through the bearing pad from the cylinder to the fluid chamber.

5. Apparatus as set forth in claim 4, wherein the fluid cavity in each bearing pad defines a surface area on the pad less than the cross sectional area of the cylinder.

6. Apparatus as set forth in claim 1, wherein:

said feet of the pistons are coupled with the respective flat surfaces of the polygon for linear sliding movement thereon as the pistons reciprocate in the cylinders;

each foot has a fluid chamber therein adjacent the corresponding flat surface of the polygon; and each foot has a passageway therein providing communication between the passage of the piston and said fluid chamber to provide a fluid cushion in each fluid cavity for facilitating sliding of the feet on said flat surfaces of the polygon.

7. Apparatus as set forth in claim 6, wherein the fluid chamber in each foot defines a surface area on the foot less than the cross sectional area of the cylinder.

8. Apparatus as set forth in claim 1, wherein said cam means comprises a spherical element inside of said cylindrical member having a spherical outer surface abutting a spherical inside surface of said cylindrical member.

9. Apparatus as set forth in claim 8, wherein:

said spherical element comprises a spherical sleeve; and said cam includes a pin on which said spherical sleeve is fitted.

10. Radial pump/motor apparatus comprising:

a housing defining a rotor chamber therein and having a fluid inlet opening and a fluid outlet opening;

a rotor mounted in said rotor chamber for rotation about a rotor axis, said rotor presenting a plurality of spaced apart cylinders extending radially of said rotor axis;

a piston mounted in each cylinder for reciprocation therein radially of the rotor axis;

a sphere element mounted in said housing at a location offset from the rotor axis;

a sleeve on said sphere element having a spherical inside surface mating with and engaging said sphere element;

a polygon mounted for rotation on said sleeve and having a plurality of flat surfaces equal in number to the number of pistons;

a foot on each piston, said feet being coupled with the corresponding flat surfaces of said polygon to effect reciprocation of the pistons in the cylinders when the rotor turns;

a fluid passage in said rotor for each cylinder, said fluid passages extending to the respective cylinders to direct fluid to and from the cylinders; and means for selectively providing communication between said fluid passages and the inlet and outlet openings of the housing in accordnce with the rotative position of the rotor.

11. Apparatus as set forth in claim 10, wherein said sphere element comprises a pin and an externally spherical sleeve fitted on said pin.

12. Apparatus as set forth in claim 10, including:

a bearing surface outside of said rotor;

a bearing pad in each cylinder at a location to bear against said bearing surface;

a fluid chamber in each bearing pad adjacent the bearing surface; and means for directing fluid into each fluid chamber when the rotor is rotating.

13. Apparatus as set forth in claim 10, wherein each foot has a generally rectangular surface adjacent the corresponding flat surface of the polygon.

14. Apparatus as set forth in claim 13, including:

a fluid chamber in said rectangular surface of each foot; and means for directing fluid into each fluid chamber when the rotor is rotating.

15. Apparatus as set forth in claim 14, wherein said fluid directing means comprises:

a passage through each piston extending to said fluid chamber; and check valve means in each piston passage for preventing fluid flow outwardly therethrough when the rotor is rotating.

16. Apparatus as set forth in claim 14, including:

a fluid cavity in each flat surface of the polygon between the polygon and sleeve; and means for directing fluid into each fluid cavity when the rotor is rotating.

* * * * *